United States Patent [19]

Medgyesy et al.

[11] Patent Number: 4,778,334

[45] Date of Patent: Oct. 18, 1988

[54] CENTRIFUGAL PUMP

[75] Inventors: Stephen Medgyesy, Andelfingen, Switzerland; Fernando Bermudez, Lake Oswego, Oreg.

[73] Assignee: Sulzer Brothers Limited, Winterthur, Switzerland

[21] Appl. No.: 40,928

[22] Filed: Apr. 21, 1987

[30] Foreign Application Priority Data

Apr. 30, 1986 [CH] Switzerland ..... 177986

[51] Int. Cl.[4] ..... F04D 29/60

[52] U.S. Cl. ..... 415/199.1; 415/DIG. 3; 416/198 A

[58] Field of Search ..... 415/199.1, 212 R, 213 R, 415/DIG. 3; 416/244 R, 244 A, 198 R, 198 A

[56] References Cited

U.S. PATENT DOCUMENTS

| | | | |
|---|---|---|---|
| 3,802,795 | 4/1974 | Nyeste et al. | 415/199.1 |
| 4,029,437 | 6/1977 | Aubry et al. | 416/244 A |
| 4,314,396 | 2/1982 | Nunlist et al. | 29/156.8 R |
| 4,493,611 | 1/1985 | Funakoshi et al. | 415/199.1 |
| 4,697,987 | 10/1987 | Katayama et al. | 416/198 A |

FOREIGN PATENT DOCUMENTS

| | | | |
|---|---|---|---|
| 3410931 | 9/1985 | Fed. Rep. of Germany | 415/199.1 |
| 637185 | 7/1983 | Switzerland | 415/199.1 |

*Primary Examiner*—Robert E. Garrett
*Assistant Examiner*—John T. Kwon
*Attorney, Agent, or Firm*—Kenyon & Kenyon

[57] ABSTRACT

The centrifugal pump has a pair of multi-stage sub-blocks wherein the impellers are shrink fitted onto the shaft. The impellers on the drive-side sub-block have shrunk fit regions in the side away from the inflow while the shrunk fit regions of the impellers remote from the drive are located on the inflow side. The shaft is made with a reduced shaft section to receive the impellers of the remote sub-block and permit the hubs of the impellers of this sub-block to be radially enlarged for shrink-fitting purposes. A center piece which separates the sub-pumps is connected via screw bolts and nuts with the last guide wheel of the drive-side sub-block.

8 Claims, 3 Drawing Sheets

CENTRIFUGAL PUMP

This invention relates to a centrifugal pump. More particularly, this invention relates to a centrifugal pump having a one-piece casing and a slidably mounted multi-stage assembly.

As is known, various types of centrifugal pumps have been constructed in a multi-stage arrangement. For example, Swiss Pat. No. 637,185 describes a centrifugal pump which has a one piece casing which houses a slidably mounted inner block which contains two multi-stage sub-blocks directed towards each other for the formation of two independent sub-pumps. In this construction, the diameter of the drive-side sub-block is smaller than the diameter of the sub-block remote from the drive. In addition, the inner block includes a shaft on which the sub-blocks are mounted and a bearing on the drive side which is smaller than the smallest diameter of the casing in which the inner block is mounted. In this way, the sub-assembly of sub-shaft and sub-blocks can be slid into the casing from one end.

In order to be able to move a sub-assembly axially into the casing, the two sub-blocks have been built up from the center toward each end. Because of this, the impellers can only be slipped onto the shaft and cottered but cannot be shrink-fitted onto the shaft. This is because, the hub region of an impeller of the sub-block remote from the drive on which a shrink fit would be made is not accessible for heating.

If such pumps are to be used for high pressures, for example greater than 200 bars and/or for high speeds, for example greater than 3,000 revolutions per minute (rpm), it is practically an absolute necessity to shrink-fit the impellers for reasons of strength and rotor dynamics.

Accordingly, it is an object of the invention to provide a modified centrifugal pump having multi-stage sub-blocks with impellers which can be shrink-fitted onto a shaft.

It is another object of the invention to provide a centrifugal pump with an inner block construction having multi-stage sub-blocks which can be used at high speed and pressures.

Briefly, the invention provides a centrifugal pump which is comprised of a one-piece casing, a shaft and an inner block which is slidably mounted within the casing and on the shaft.

In accordance with the invention, the shaft has a first section of a first diameter and a second section of a second diameter less than the first diameter. In addition, the inner block includes a first multi-stage sub-block mounted on the first shaft section for forming a first sub-pump and a second multi-stage and sub-block mounted on the second shaft section for forming a second sub-pump and having an outside diameter greater than the first sub-pump. Further, the first sub-block includes a plurality of impellers having hubs on a downstream side which are shrink-fitted on the shaft while the second sub-block includes a plurality of impellers having hubs on an upstream side shrink-fitted on the shaft.

In addition, the innner block includes a center piece which is between and which separates the sub-blocks from each other. Further, the first sub-block which is on the drive side of the pump includes a guide wheel at one end which faces the center piece and which is secured thereto. In this respect, the guide wheel has a plurality of circumferentially spaced cutouts which receive screw bolts which are threaded into the center piece as well as nuts which are threaded onto the bolts within the coutouts so as to secure the guide wheel to the center piece. In addition, the bolts extend through the sub-block for securing the multiple stages of the sub-block together. These tie bolts also extend through the cutouts of the guide wheel adjacent the center piece in alternating relationship with the screw bolts.

The inner block can be built up from a drive side end in one direction. In this respect, the sub-block having the greater inside diameter is built up first.

The reduction of the shaft diameter for the sub-block remote from the drive permits an increase in the radial thickness of the hubs of the impellers on the inflow or upstream side without necessarily changing the hydraulic parameters such as the impeller diameter and the specific rotational speed or wheel form characteristic. Further, the increase in the radial thickness of the hub on the inflow side of the impeller facilitates shrink-fitting of the hub onto the shaft so that accessability for the heating of the shrink area is ensured.

The reduction of the shaft diameter is made possible, especially in the case where the two sub-blocks are hydraulically identical in design, by the fact that the drive power to be transmitted from the shaft to the sub-pump remote from the drive is now only one half the total power.

The construction of the pump from one side requires that the tie bolts which hold the sub-blocks together must be "threaded" from the side remote from the drive. The thus occurring problem of connecting the drive-side sub-block with the center piece is solved by having the screw bolts recessed in the cutouts between the center piece and the last wheel of the sub-block along with the nuts which are tightened from the outer circumference of the block.

Apart from the rotation of speed, the two sub-pumps are independent of each other. Thus, the two sub-pumps can be connected together in series in order to increase the delivery head at constant delivered quantity or in parallel in order to increase the delivered quantity at constant delivery head. If any adequate pressure water supply is available, one of the sub-pumps may be used as a turbine for the drive of the other sub-pump.

Different hydraulic layouts for the two sub-pumps are also possible. Thus, the delivered quantity of flow may be divided after the first sub-pump with one partial quantity being put to use while the remaining partial quantity is raised to a second higher pressure level in the second sub-pump. A simple and space-saving construction to achieve this is to connect the two sub-blocks in series with one another at least for a partial flow quantity within the casing. To this end, a pressure pipe may be connected to the last guide wheel of the drive-side sub-block with means for adjusting the flow cross-section of the pressure pipe for the withdrawal of a partial quantity of flow.

These and other objects and advantages of the invention will become more apparent from the following detailed description taken in conjunction with the accompanying drawings wherein.

Figure 1:
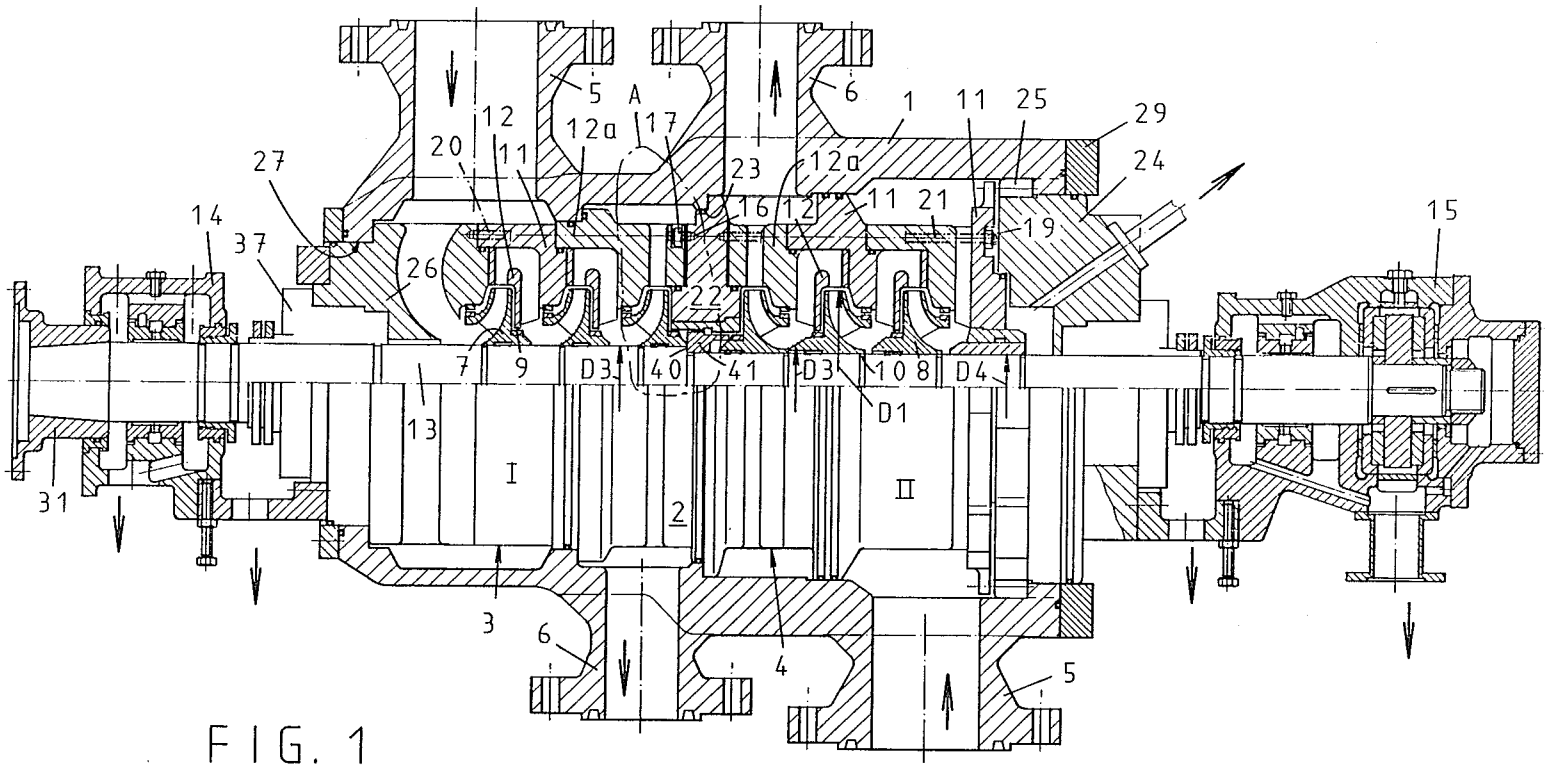
FIG. 1 illustrates a partial cross-sectional view of a centrifugal pump constructed in accordance with the invention.

Referring to FIG. 1, the centrifugal pump includes a one piece casing 1 which is axially undivided and a drive shaft 13 which extends through the casing 1 and which is supported in bearings 14, 15 at opposite ends. In addition, the pump includes an inner block or cartridge 2 which has a pair of multi-stage sub-blocks 3, 4 mounted within the casing 1.

The sub-blocks 3, 4 form two separate sub-pumps I, II which, except for the common drive shaft 13 are independent of each other. As indicated, each sub-block 3, 4 cooperates with a suction pipe 5 and a compression pipe 6, respectively through which separate flows are conducted.

As illustrated, the shaft contains two sections within the casing 1 which are of different diameter relative to each other. For example, one section which is on the drive side is a diameter D3 while the second section is of a diameter D4 which is less than the diameter D3. Further, the drive side sub-block 3 has a plurality of impellers 7 having hubs on a downstream side which are shrink-fitted on the shaft 13. Likewise, the sub-block 4 includes a plurality of impellers 8 having hubs on an upstream side or inflow side which are shrink fitted on the reduced diameter section of the shaft 13.

As shown in FIG. 1, the hubs of the impellers 7 for the drive-side sub-block 3 have an internal diameter which is equal to the outside diameter of the shaft D3. Further, each hub is shrunk fit in a downstream region 9 onto the shaft 13. On the other hand, the impellers 8 of the remote sub-block 4 have radially enlarged hubs which are shrunk fit in regions 10 located on the upstream side of each impeller 8. These impellers 8 also have an inside diameter which is equal to the reduced diameter section of the shaft 13 that is, a diameter D4. However, the outer diameter of each shrink fit region 10 has a diameter D3 which is equal to the diameter of the enlarged shaft section on which the sub-block 3 is mounted. Thus, the hydraulic layout of the two sub-pumps I, II can be made equal.

As illustrated in FIG. 1, the outside diameters D1 of the impellers 7, 8 and the widths of each impellers 7, 8 are the same in mutually corresponding stages for both sub-blocks 3, 4.

As also shown in FIG. 1, a stepped offset 40 between the two sections of the shaft 13 may have an abutting throttle bushing 41 thereat.

The sub-block 3 has a plurality of stator parts consisting of an inflow casing 26, step casings 11 and guide wheels 12. In similar manner, the remote sub-block has stator parts consisting of step casings 11 and guide wheels 12. These stator parts are held together by tie bolts 20, 21 and nuts 18, 19, respectively. Further, a center piece 22 is centered in a casing between the sub-blocks 3, 4 in order to separate the sub-blocks 3, 4 from each other. The tie bolts 21 of the remote sub-block are simply screwed into a corresponding thread in the center piece; however, the tie bolts 10 hold only the stator parts of the sub-block 3 together since the inner block 2 should be constructed completely from the drive side in one direction.

Figure 4:
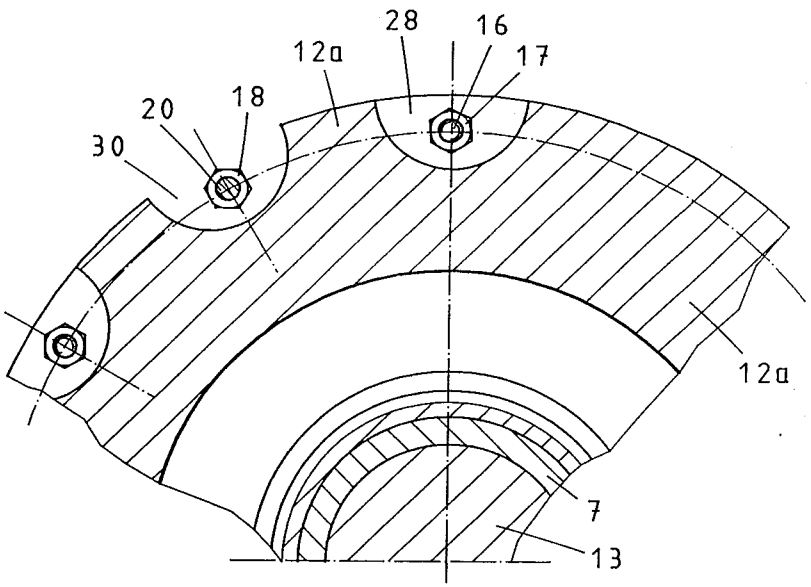
FIG. 4 illustrates a view taken on line IV—IV of FIG. 3.
Figure 3:
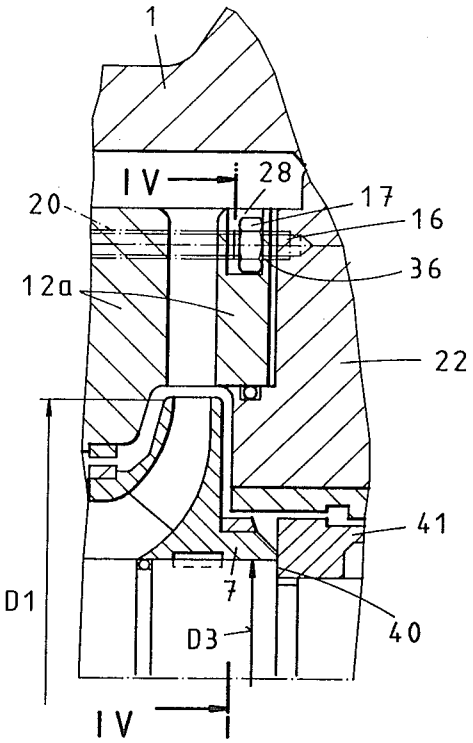
FIG. 3 illustrates a view of a detail A in FIG. 1.

Referring to FIGS. 1, 3 and 4, the connection of the last guide wheel 12*a* of the drive-side sub-block 3 to the center piece 22 is made by means of separate screw bolts 16 and nuts 17. To this end, the guide wheel 12*a* is provided with a plurality of circumferentially spaced cutouts 28, 30 which are distributed at regular angle intervals of 30°. Each screw bolt 16 is threaded into the center piece 22 and has an end disposed in a cutout 28. In addition, a nut 17 is threaded onto each screw bolt 16 within a cutout 28. Hence, by tightening the nut 17 on the screw 16, the guide wheel 12*a* can be connected with the center piece 22. The tie bolts 20 on the other hand, extend through the alternating cutouts 30 can receive threaded nuts 18 thereon within the respective cutouts 30. Thus, by tightening of the nuts 18, the stator parts of the sub-block 3 can be secured together.

As indicated in FIG. 1, the bearing 15 which is remote from the drive is supported via a cover 24 by the casing 1. The cover 24 is secured, for example by means of a bayonet lock 25 in the casing 1 and is sealed by means of a flanged ring 29, for example as described in U.S. Pat. No. 4,701,103 and in German C3410931. The bearing 14 which is on the drive side is carried out by the inflow casing 23 which, in turn, is centered in a bore 27 in the casing 1 and, simultaneously forms a drive-side cover for the casing 1. Suitable mechanical seals 37 which are shown schematically may also be arranged between the shaft 13 and the respective covers 24, 26.

The pump is driven by a drive machine (not shown) such as an electric motor which is connected with the shaft 13 by means of a clutch 31.

When in operation, a flow enters into each of the suction pipes 5 to the respective sub-pumps I, II and, after flowing through the impellers 7, 8 respectively, exits through the compression pipes 6, respectively.

The assembly of the pump can be performed from one side of the casing 1. For example, the drive-side bearing 14 is first mounted on the shaft 13. In this respect, this bearing 14 has an outer diameter which is less than the smallest inside diameter of the casing so as to be able to pass through. Thereafter, the components of the sub-block 3 can be slid onto the shaft with the respective impellers 7 being heated in the hub regions 9 so as to be shrunk-fit on the shaft 13. The tie bolts 20 can then be threaded through the aligned stator parts to secure these parts together as noted above.

Thereafter, the center piece 22 can be provided with the screw bolts 16 and then aligned with the guide wheel 12*a* of the sub-block 3 so that the screw bolt 16 pass through bores 36 in the guide wheel 12*a* and into the nuts 17. The nuts 17 can then be tightened from the periphery of the guide wheel 12*a* to fix the center-piece 22 to the sub-block 3.

The stepwise construction of the sub-block 4 can then be performed with the enlarged hub regions 10 of the impellers 8 being heated for shrink-fitting onto the shaft 13. Thereafter, the tie bolts 21 can be passed through the stator parts of the sub-block 4 and into the aligned center piece 22 to secure the sub-block 4 to the center piece 22. This completed assembly may then be slid into the casing 1.

Thereafter, the cover 24 is fitted in place and the bearing 15 secured about the end of the shaft 13.

Figure 2:
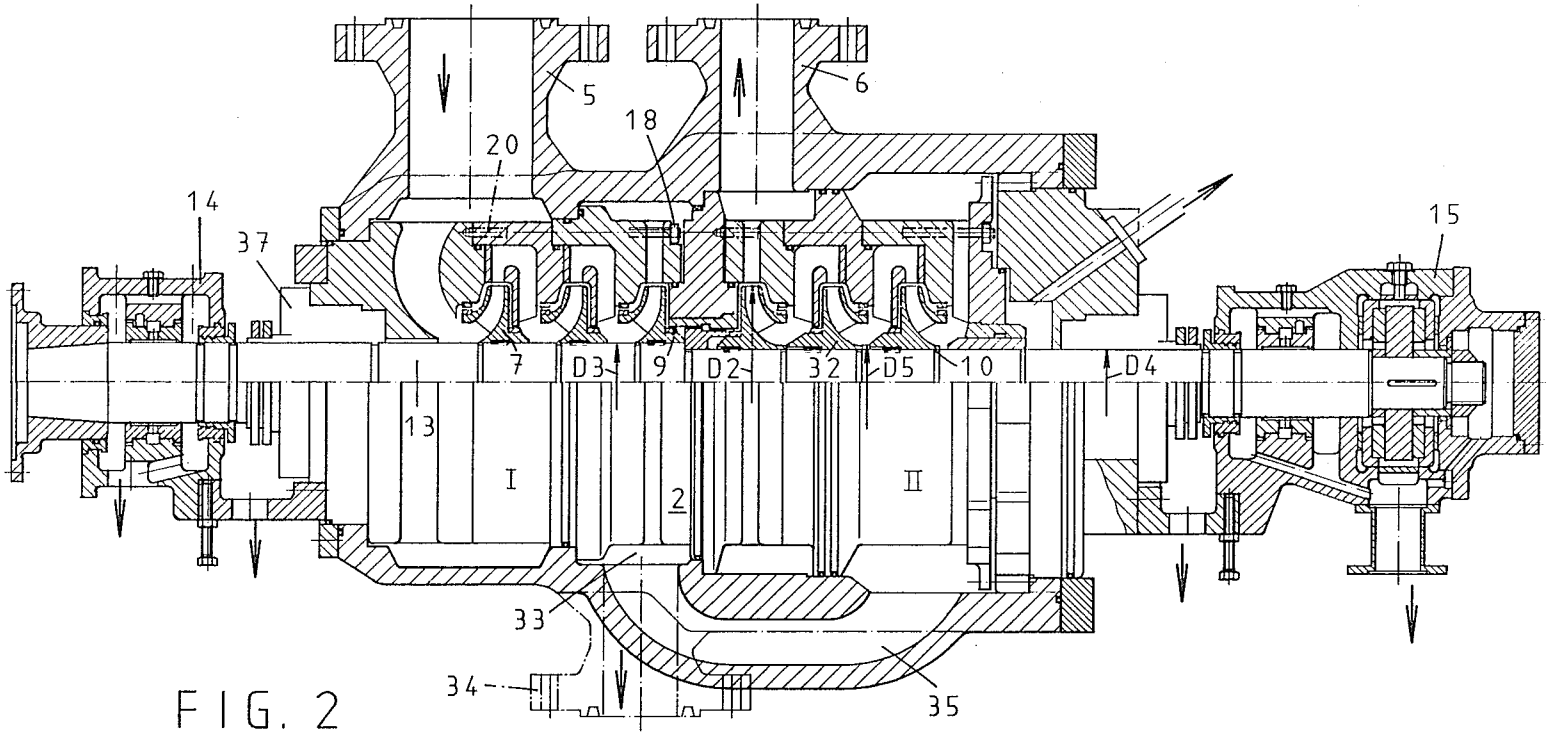
FIG. 2 illustrates a similar view to FIG. 1 of a second embodiment of a centrifugal pump constructed in accordance with the invention.

Referring to FIG. 2, wherein like reference characters indicate like parts as above, the centrifugal pump may be constructed so that the hydraulic parameters of the sub-pumps I, II are different from each other. In this case, the impellers 32 of the sub-pump II remote from the drive have an inside hub diameter D5 different from the shaft diameter D3 and the inside diameter of the impellers 7. Also, the outside diameters D2 and the widths of the impellers 8 are different from the impellers 7 of the sub-pump I. The different hydraulic parameters, i.e. impeller hub and outside diameters and wheel form characteristic are necessary because the pump is constructed so that there is a division of the delivered quantity of flow after the first sub-pump I and a further pressure increase is to take place for the remaining partial quantity of flow.

As indicated, the last step guide wheel 12*a* of the sub-block 3 communicates with an annular chamber 33 which connects with a pressure pipe 34 for the withdrawal of a partial quantity of flow and with a means defining an inner flow path 35 wherein the casing 1 for delivering the remaining partial flow to the sub-pump II. This flow path 35 thus connects the sub-pumps I, II in series.

The distribution of a partial flow quantities over the two flow paths can be obtained by means of an adjustable or controllable throttle system in a pressure line (not shown) connected to the pressure pipe 34.

As indicated in each of FIGS. 1 and 2, the outside diameter of the sub-pump II is of a greater diameter of the sub-pump I to accommodate the axial movement of the block 2 into the casing 1.

The invention thus provides a centrifugal pump which can be used for relatively high pressures, for example greater than 200 bars and/or for high speeds, for example greater than 3,000 rpm.

Further, the invention provides a centrifugal pump having a pair of sub-pumps wherein the impellers of the sub-pumps can be shrunk-fitted onto a common shaft so that the pump can be fabricated from one end of the casing.

We claim:

1. A centrifugal pump comprising a one piece casing;

a shaft having a first section of a first diameter and a second section of a second diameter less than said first diameter; and an inner block slidably mounted within said casing, said block including a first multi-stage sub-block mounted on said first shaft section for forming a first sub-pump, and a second multi-stage sub-block mounted on said second shaft section for forming a second sub-pump and having an outside diameter greater than the outer diameter of said first sub-pump, said first sub-block including a plurality of impellers having hubs on a downstream side shrink-fitted on said shaft and said second sub-block including a plurality of impellers having hubs on an upstream side shrink-fitted on said shaft.

2. A centrifugal pump as set forth in claim 1 wherein said inner block includes a center piece between and separating said sub-blocks from each other and said first sub-block includes a guide wheel at one end facing said center piece with a plurality of circumferentially spaced cutouts and which further comprises screw bolts threaded into said center piece and disposed in said cutouts, nuts threaded onto said bolts within said cutouts and tie bolts extending through said first sub-block for securing said stages thereof together.

3. A centrifugal pump as set forth in claim 2 wherein said impellers of said sub-blocks have an equal outside diameter and said sub-blocks have equal specific rotational speeds.

4. A centrifugal pump as set forth in claim 2 wherein said pump casing includes means defining an inner flow path between said sub-blocks to connect said sub-blocks in series for at least a partial flow.

5. A centrifugal pump as set forth in claim 4 which further comprises a pressure pipe connected to said guide wheel of said first sub-block for withdrawal of a partial quantity of flow therefrom.

6. A centrifugal pump as set forth in claim 2 wherein said impellers of said sub-blocks have equal outside diameters.

7. A centrifugal pump as set forth in claim 1 which further comprises a bearing at a drive end of said shaft having an outside diameter less than the smallest inside diameter of said casing for axial passage therethrough.

8. A centrifugal pump as set forth in claim 1 wherein said shaft includes a stepped offset between said sections thereof.

* * * * *

UNITED STATES PATENT AND TRADEMARK OFFICE

CERTIFICATE OF CORRECTION

PATENT NO. : 4,778,334

DATED : Oct. 18, 1988

INVENTOR(S) : Stephen Medgyesy

It is certified that error appears in the above-identified patent and that said Letters Patent is hereby corrected as shown below:

Title page:

In the Abstract, line 4 "in" should be -on-
Column 1, line 54 "multi-stage and sub-block" should be --multi-stage sub-block-
Column 3, line 60 "10" should be -20-
Column 4, line 8 "can" should be -and-
Column 4, line 18 "carried out by" should be -carried by-
Column 4, line 44 "bolt 16" should be -bolts 16-
Column 5, line 11 "wherein" should be -within-
Column 5, line 15 cancel "a"
Column 5, line 20 "of" should be -than- (third occurrence)

Signed and Sealed this

Sixteenth Day of May, 1989

*Attest:*

DONALD J. QUIGG

*Attesting Officer*

*Commissioner of Patents and Trademarks*